United States Patent [19]

Zellmer et al.

[11] 3,958,490

[45] May 25, 1976

[54] SELF-COCKING ROCKET LAUNCHER DETENT

[75] Inventors: Wayne G. Zellmer; Marvin E. McGowan, both of China Lake, Calif.

[73] Assignee: The United States of America as represented by the Secretary of the Navy, Washington, D.C.

[22] Filed: Dec. 19, 1974

[21] Appl. No.: 534,383

[52] U.S. Cl. ..... 89/1.807; 89/1.814

[51] Int. Cl.[2] ..... F41F 3/04

[58] Field of Search ..... 89/1.806, 1.807, 1.808, 89/1.813, 1.814, 1.816

[56] References Cited

UNITED STATES PATENTS

| | | | |
|---|---|---|---|
| 2,751,818 | 6/1956 | Bonnett | 89/1.807 |
| 2,764,066 | 9/1956 | Doak et al. | 89/1.807 |
| 2,830,496 | 4/1958 | Anderson et al. | 89/1.807 |
| 2,830,497 | 4/1958 | Smoot et al. | 89/1.806 |
| 2,938,431 | 5/1960 | Dixon | 89/1.807 |
| 3,842,711 | 10/1974 | Bodinaux | 89/1.814 X |

*Primary Examiner*—David H. Brown
*Attorney, Agent, or Firm*—R. S. Sciascia; Roy Miller; Gerald F. Baker

[57] ABSTRACT

A prior art rocket detent mechanism is provided with a lever operated cable pull attached to the rotatable detent such that the rocket tube may be reloaded and the detent reset without the necessity of reaching into the launcher tube with special tools. The lever is integral with the forward end of the reset rod and a cable affixed thereto is threaded through a pair of pad eyes and attached to the rotary detent pawl. Rotation of the rod and lever with respect to the forward pad eye exerts sufficient tension on the cable to reposition the detent when reloading the launcher tube.

4 Claims, 5 Drawing Figures

SELF-COCKING ROCKET LAUNCHER DETENT

CROSS REFERENCE TO RELATED APPLICATIONS

This invention is an improvement in the rocket launching system disclosed in assignee's prior application Ser. No. 138,840 filed Apr. 29, 1971 and now U.S. Pat. No. 3,748,954 issued July 31, 1973.

BACKGROUND OF THE INVENTION

The location of the detent in previous 5.00-In. launchers was close enough to the front of the tubes, so that a person could reach into the tube with a tool, such as a screwdriver, and recock the detent in preparation for reloading a fired launcher. The detent was thus designed so that this was the only way of recocking the detent.

With the task of providing a much longer launcher, in the forward direction, came the problem that the detent could no longer be reached with conventional tools. After firing, the detent in the lengthened launcher tube is in such a position and so far back that it would be difficult to recock with any sort of tool used inside the launcher tube and since the launcher requires a fire protection layer on or under the outer skin, a detent access door would be detrimental to fire protection.

SUMMARY OF THE INVENTION

According to the present invention, the detent reset mechanism as modified eliminates the need for the use of externally applied tools to effect repositioning the detent pawl when reloading the launcher.

DESCRIPTION AND OPERATION

Figures 1, 1A:
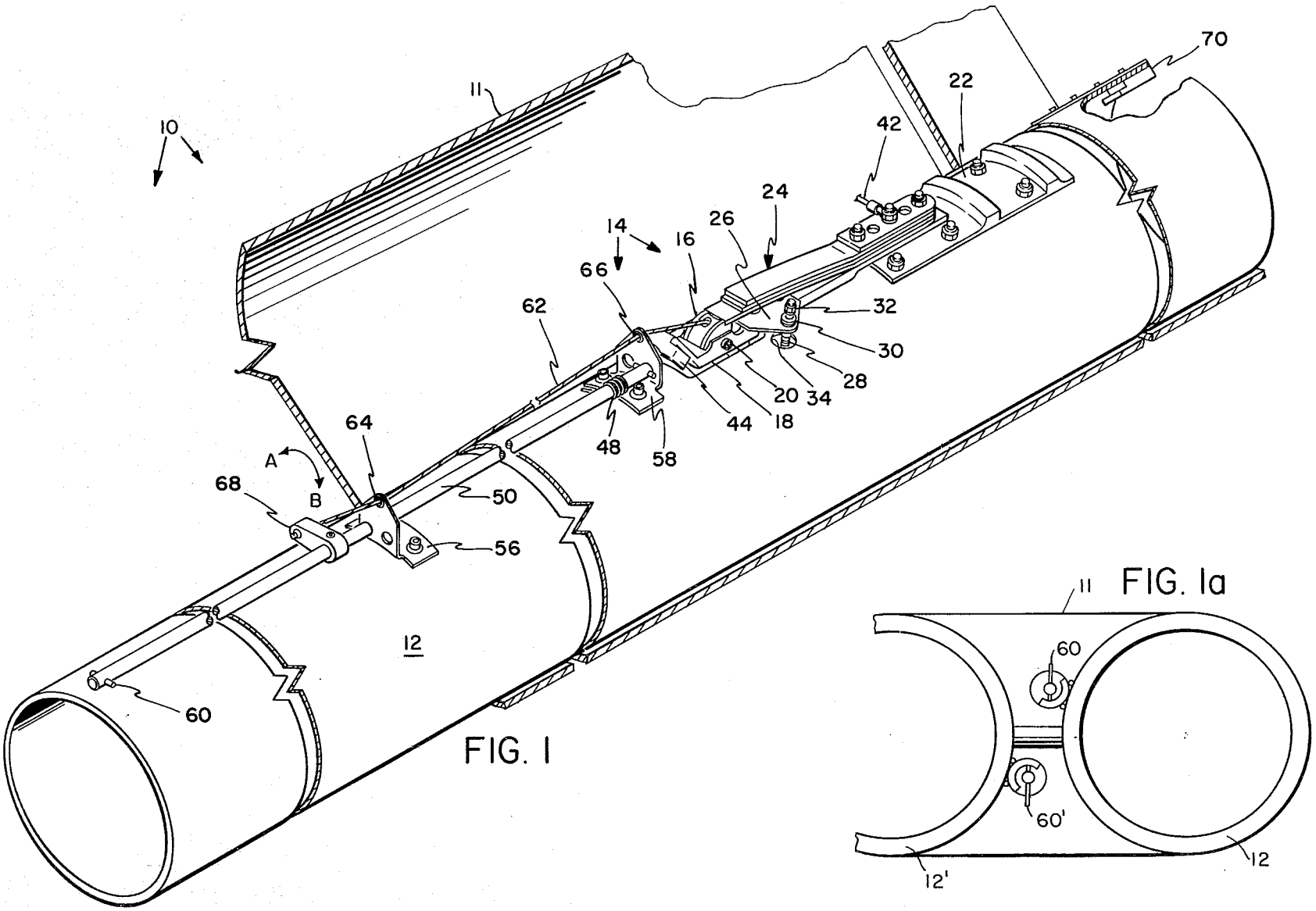
FIG. 1 is a perspective view of a rocket launcher system embodying the present invention with parts removed and broken away for clarity.
FIG. 1a is an end view of the launcher of FIG. 1.

The rocket launcher system generally indicated by the numeral 10 in FIG. 1 essentially consists of a casing or skin 11 housing at least one a rocket tube 12 and a rocket contact and detent mechanism 14. The detent pawl 16, which holds the rocket in place within the tube, is rotatably secured to the forward end of a detent arm 18 by means of a pivot pin 20. The aft end of arm 18 is fastened to a stiffener plate 22 on tube 12. A composite leaf spring 24 is also attached to stiffener 22 for cooperation with the pawl 16 as will be described below.

The arm 18 also carries a tongue 26 on which is mounted the contact screw 28. Screw 28 is fastened to the tongue 26 through an insulating ferrule 30 and may be fastened to a firing circuit conductor by means of nut 32. The screw 28 protrudes through a hole 34 provided in rocket tube 12 to reach the rocket firing ring (not shown).

Figure 2:
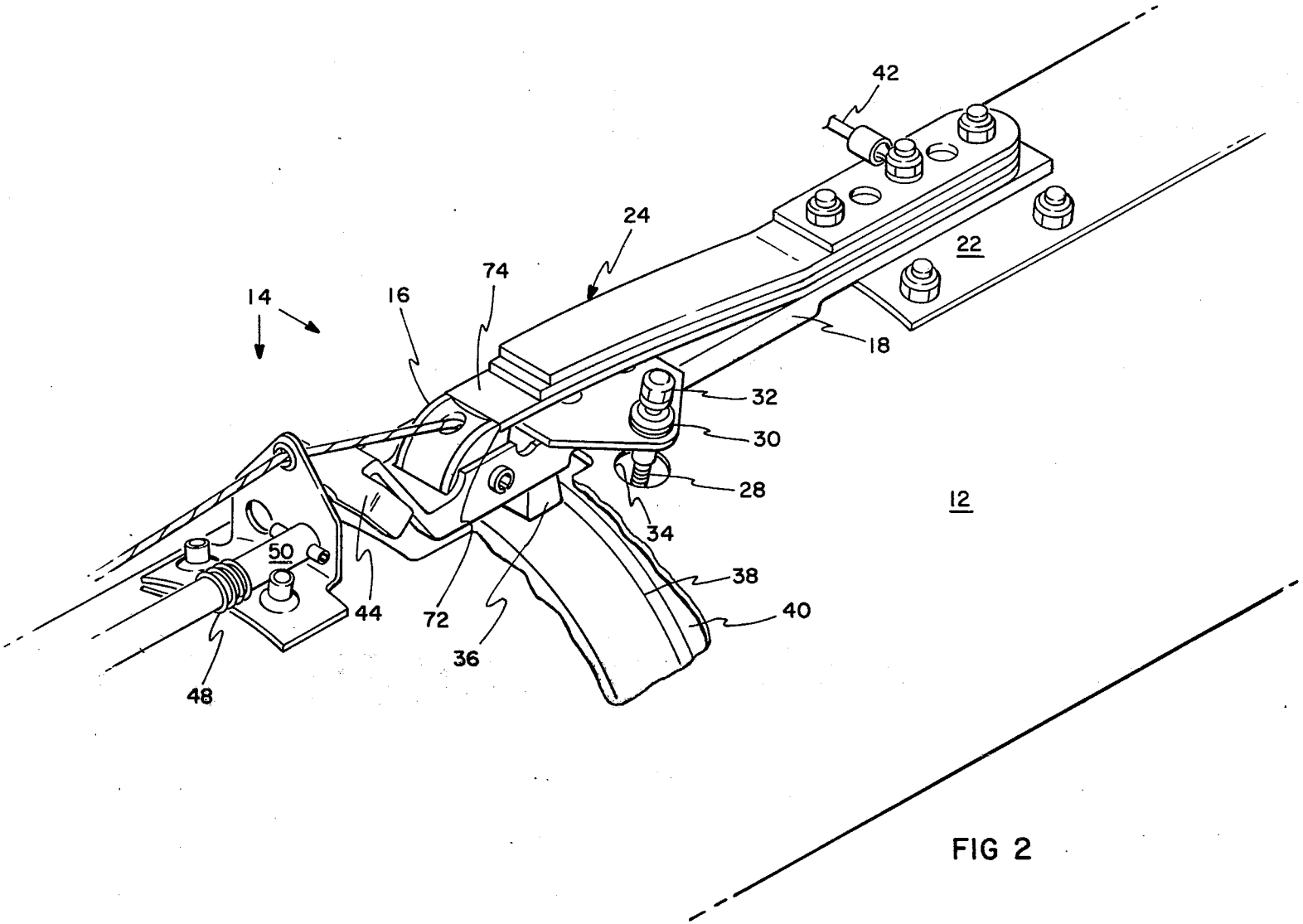
FIG. 2 is an enlarged detail of FIG. 1 showing the mechanism in position before firing.

Pawl 16 comprises a detent tab 36 which is best seen in FIG. 2. Which protrudes, in the position shown, into a groove 38 provided in rocket 40. The pawl 36 provides a positive ground contact with the rocket body, the rocket tube and the ground side of the rocket circuitry through a conductor 42 shown fastened to one of the screws which attaches the arm 18 and spring system 24 to the rocket tube.

Figures 3, 4:
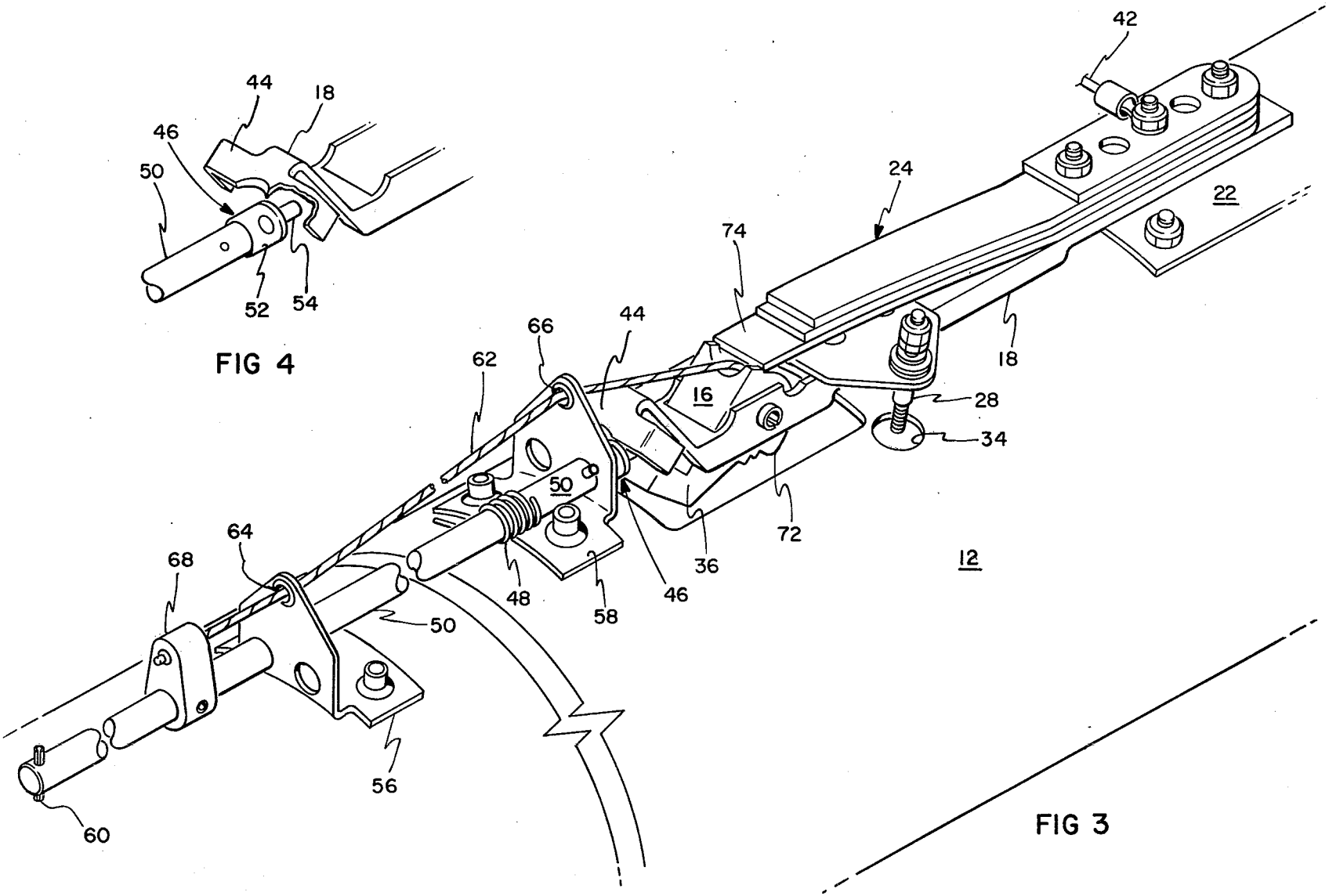
FIG. 3 is a view similar to FIG. 2 showing the mechanism after firing.
FIG. 4 is an enlarged detail of FIG. 3.

Detent arm 18 carries on its forward end a lifting tab 44 which cooperates with an operating mechanism 46 best shown in FIGS. 3 and 4. The operating mechanism 46 is biased to the position shown in FIG. 3 by a coil spring 48 acting upon an operating rod 50. Operating rod 50 carries on its aft end a detent lifting mechanism comprising crank 52 and a pin 54.

Operating rod 50 is rotatably mounted on tube 12 by means of two brackets 56, 58. Rod 50 may be manually rotated between its limits of travel by using a tool in cooperation with means 60 on the forward end of the rod which is accessable from the forward end of the rocket system.

Means is provided in the detent operating mechanism 46 for resetting the pawl 16 including cable 62 attached to pawl 16 at one end, running through eyes 64, 66 on brackets 56, 58 respectively and attached to a crank arm 68 fixed on the forward end of rod 50. FIGS. 1 and 2 illustrate the position of parts in fire position when the rocket tube 12 contains a rocket ready for firing. The detent arm 18 which carries the detent pawl 16 is at its lower limit of travel and the tab 36 of pawl 16 is seated in the groove 38 in rocket 40 as shown in FIG. 2. In this position, pawl 16 is near the limit of its counterclockwise travel, cable 62 is in its forwardmost position and operating rod 50 is near its limit of counterclockwise travel. In this position of control rod 50, spring 48 is under tension. The detent pawl 16 in this position, may not be rotated in a clockwise direction except by the exertion of considerable force causing flexion of spring system 24 to allow the escape of surface 72 from the leaf 74 of the spring system.

When the rocket 40 is fired, sufficient force is exerted by rocket 40 on tab 36 to rotate detent 16 clockwise to the position shown in FIG. 3. Rotation of pawl 16 causes elevation of detent arm 18 and allows movement of the operating rod in a clockwise direction under the influence of spring 48 to the position shown in FIG. 3. In this position the operating mechanism 46 holds the detent arm 18 in the elevated position with the tab 36 of pawl 16 and the contact screw 28 both clear of the rocket tube.

In this position the launcher in the load position is ready for reloading except for the resetting of pawl 16. This resetting was previously accomplished by rotating rod 50 to lower pawl 16 into the tube 12 and with a tool from the front end of the launcher jabbing at the pawl until the surface 72 was in front of the front end of spring 74. Rod 50 was then rotated clockwise to lift pawl 36 in position for lowering into groove 38 of a rocket as shown in FIG. 2.

According to the present invention when the fired launcher is to be reloaded the operating rod is rotated counterclockwise causing cable 62 to be pulled by lever 68 and thus rotate pawl 16 until surface 72 is reset at the front end of spring member 74. The rod 50 is then rotated clockwise to lift the detent arm 18 and contact screw out of tube 12 and the system is in the RESET position ready for reloading.

From the foregoing it will be appreciated that a self-cocking detent mechanism has been provided for a rocket launcher which facilitates reloading by eliminating the necessity for makeshift cocking of the detent pawl by such methods as poking a long screwdriver or the like into the rocket tube.

What is claimed is:

1. A missile launcher system including;

at least one launcher tube;

detent means intermediate the ends of said tube effective to hold a missile in place within said tube and to delay launch of said missile until a predetermined thrust has been exerted on said detent means by said missile;

manually operable means mounted on said tube and operatively connected with said detent means for selectively moving said detent means into and out of contact with said missile;

said manually operable means including means extending to a point near the forward end of said tube to facilitate access;

said detent means including a pawl pivotally mounted for movement between a first position ready for placement into contact with a missile to be launched and a second inoperative position effected by movement of the missile out of said tube; and reset means operatively associated with said manually operable means effective to move said pawl to a RESET position.

2. A missile launcher according to claim 1 wherein: said manually operable means comprises a shaft and crank mechanism fixed on said tube for rotation between said first position with the detent means wholly without the tube and a second position with the detent pawl in contact with a missile in said tube.

3. The missile launcher according to claim 2 wherein said shaft and crank mechanism is biased in the direction of and is operable to hold said detent in said first position.

4. The missile launcher according to clam 3 wherein said reset means includes:

a lever on said mechanism;

guide means fixed to said tube; and a flexible cable operably attached at one end to said lever and passing through said guide means and attached at the other end to said pawl so that rotation of said shaft and crank mechanism to move from said first position to said second position will cause rotation of said pawl to its RESET position simultaneously with movement of the detent means into a position in contact with a missile to be launched.

* * * * *